United States Patent [19]

Altman

[11] Patent Number: 4,851,972

[45] Date of Patent: Jul. 25, 1989

[54] MOISTURE RESISTANT LIGHTING TUBE

[75] Inventor: Peter W. Altman, Philadelphia, Pa.

[73] Assignee: Light and Sound Specialties, Inc., Philadelphia, Pa.

[21] Appl. No.: 48,162

[22] Filed: May 11, 1987

[51] Int. Cl.[4] ..... F21V 29/00

[52] U.S. Cl. ..... 362/267; 362/236

[58] Field of Search ..... 362/267, 227, 236, 158, 362/310

[56] References Cited

U.S. PATENT DOCUMENTS

| | | | |
|---|---|---|---|
| 459,872 | 9/1891 | Tommasi | 362/158 |
| 3,714,414 | 1/1973 | Sternius | 362/267 X |
| 4,271,458 | 6/1981 | George, Jr. | 362/236 |
| 4,376,966 | 3/1983 | Tieszen | 362/267 X |
| 4,500,946 | 2/1985 | Mikola | 362/267 X |
| 4,521,839 | 6/1985 | Cook et al. | 362/277 X |
| 4,574,337 | 3/1986 | Poppenheimer | 362/267 |
| 4,612,607 | 9/1986 | Segoshi et al. | 362/267 |

FOREIGN PATENT DOCUMENTS

| | | | |
|---|---|---|---|
| 775503 | 11/1980 | U.S.S.R. | 362/267 |
| 11674 | of 1887 | United Kingdom | 362/158 |

*Primary Examiner*—Ira S. Lazarus
*Assistant Examiner*—Peggy Neils
*Attorney, Agent, or Firm*—Panitch Schwarze Jacobs and Nadel

[57] ABSTRACT

A moisture resistant lighting tube comprising a flexible, transparent tube of plastic polymeric material housing miniature lamps within the tube interior. Electrical connectors are encased in a hardened thermoplastic potting compound at each end of the tube. The hardened potting compound serves as a dust barrier and strain relief. Moisture free gas such as dried nitrogen is injected in the tube interior under pressure via an opening in the tube wall. The gas displaces moisture laden air within the tube. The air is expelled via another opening in the tube wall. Sealant compound is injected in both wall openings to form sealant plugs which seal the openings from the tube interior, trap the moisture free gas in the tube interior and prevent moisture from entering therein.

12 Claims, 1 Drawing Sheet

MOISTURE RESISTANT LIGHTING TUBE

BACKGROUND OF THE INVENTION

The present invention is directed to a lighting tube of the flexible, transparent type for housing miniature lamps. Such tubes are well-known. See U.S. Pat. Nos. 3,755,663, 4,263,640 and 4,271,458.

It is desireable to protect the miniature lamps and lamp conductors (wires) housed within the tube from moisture which may degrade the performance and structural integrity of the lamps and lamp conductors. In U.S. Pat. No. 4,271,458, a moisture resistant lighting tube is disclosed wherein viscous dielectric liquid such as mineral oil is introduced within the tube interior. The liquid surrounds the miniature lamps and conductors. Sealant slugs (silicone caulk or polysulphide) seal the end portions of the tube at which connectors are mounted. The assembly technique proposed in U.S. Pat. No. 4,271,458 is to insert the sealant slugs and connectors at the tube ends. Thereafter, a pair of small holes are drilled through the tube waller, a pair of small holes are drilled through the tube wall proximal the inside face of each sealant slug. One whole provides an entry port for the viscous liquid, and the other provides a suction port for the liquid. The liquid is drawn into the tube by suction. An air pocket is formed within the tube interior to accommodate internal pressure variations due to temperature changes. The holes are then sealed at the exterior with unplasticized viny film and adhesive.

In U.S. Pat. No. 4,271,458, the juction or connection point of the lamp conductors and each connector is encapsulated in the sealant slug. The sealant slugs are sufficiently resilient whereby the slugs do not provide ample strain relief for the electrical junction. The slugs are also capable of being dislodged whereby the integrity of the end seal can be broken and the lamps and conductors inadvertently extracted from the tube interior. Lighting tubes of this type may also use a gelatinous substance to fill the tube interior. Such a substance is thought to be less likely to flow through small cracks which may develop in the tube wall. The substance envelops the lamp circuit. If any of the lamps fail, the lamp circuit cannot be conveniently extracted and repaired because the substance tends to cling to the lamps and the circuit, making it difficult to remove the circuit without injuring the lamps or conductors.

The problem solved by the present invention is that of providing a moisture resistant tube for housing miniature lamps which provides superior strain relief at the electrical junction between the lamp conductors and the end connectors and which can be easily dismantled to repair the lamp circuit without injuring it.

BRIEF SUMMARY OF THE INVENTION

A moisture resistant lighting tube for housing miniature lamps comprising a tube of light transmissive material, a miniature lamp circuit disposed within the tube interior, a substantially moisture-free gas filling the tube interior, and means for forming a moisture tight seal at spaced locations along the tube interior to prevent entry of moisture therein.

A method of making a moisture resistant lighting tube for housing miniature lamps, comprising providing a tube of light transmissive material and a miniature lamp circuit within the tube interior, expelling air from the tube interior by filling the tube interior with a substantially moisture free gas, and forming a moisture tight seal of the tube interior by injecting a sealant into the tube at spaced locations therealong.

For the purpose of illustrating the invention, there is shown in the drawings forms which are presently preferred; it being understood, however, that this invention is not limited to the precise arrangements and instrumentalities shown.

DETAILED DESCRIPTION OF THE INVENTION

Figure 1:
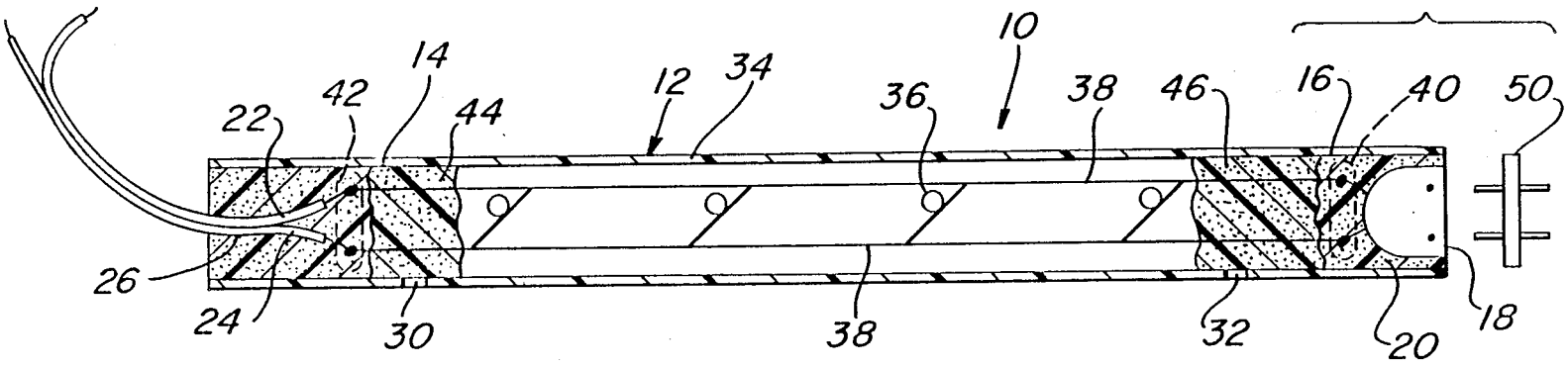
FIG. 1 is a cross-section of a generally cylindrical moisture resistant lighting tube for housing miniature lamps in accordance with the present invention.

Referring to FIG. 1 of the drawings, the moisture resistant lighting tube of the present invention is generally designated as 10. The lighting tube 10 comprises a generally cylindrical light transmissive tube 12 made of a flexible, transparent polymeric plastic material. Tube 12 has end portions 14, 16. An electrical connector in the form of a female socket 18 is partially encased at tube end portion 16 in a hardened hot melt potting compound such as "Jet-Melt" compound manufactured by 3M Company. The compound is a thermoplastic compound which hardens and adheres to tube 12 and socket 18 so as to secure the socket in place. The hardened compound serves as a dust barrier and strain relief 20 as further described hereafter.

Figure 2:
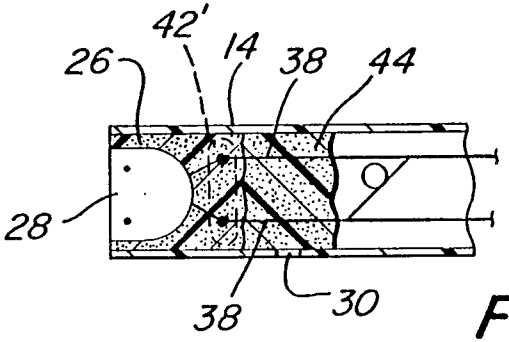
FIG. 2 is a partial section of an alternate embodiment of the invention wherein a male bi-pin connector is used.

The opposite end portion 14 of the tube is also provided with hardened hot melt potting compound which partially encases an electrical connector in the form of cable wires 22, 24. In use, the cable wires are electrically connected to a low voltage electrical power source (not shown). The hardened compound encasing the cable wires also serves as a dust barrier and strain relief 26. In an alternate embodiment of the invention, the cable wires shown in FIG. 1 may be replaced by an electrical connector in the form of a female socket 28 identical to socket 18 and partially encased in the potting compound. See FIG. 2. The female sockets of adjacent lighting tubes may be electrically connected by an interconnector 50 known as a bi-pin connector. See FIG. 1.

A pair of openings 30, 32 are drilled in the tube wall 34 at opposite end portions 14, 16 of the tube. Each opening is located near and inwardly of the associated dust barrier 20, 26. Miniature unbased lamps 36 are soldered to a pair of electrical conductors (wires) 38 thereby defining a lamp circuit within the tube interior. The conductors 38 are electrically connected at junction 40 to the socket 18, the junction being encased in the dust barrier 20. The cable wires 22, 24 are electrically connected at junction 42 to the conductors 38, the junction being encased in dust barrier 26. Alternatively, the cable wires may be replaced by female socket 28, the socket being electrically connected to the conductors 38 at junction 42' wherein junction 42' is encased in dust barrier 26. See FIG. 2. The hot melt potting compound which encases each electrical connector substantially fills the tube end portion 14 or 16 and hardens so as to rigidly encase the connector. Thus, the compound forms a rigid plug acting as a dust barrier and a superior strain relief for the electrical junction 40 or 42 (42').

A sealant plug 44 formed of a silicone compound seals tube end portion 14 at opening 30 and at the interface between tube 34 and dust barrier 26. A like sealant plug 46 seals tube end portion 16 at opening 32 and at the interface between the tube wall and dust barrier 20. The sealant plugs 44, 46 mold within the tube to the shape of the interior surface of the tube wall, sealing any gaps between the interior surface of the wall and the dust barriers 20, 26. The sealant plugs 44, 46 are relatively resilient as compared with the rigid dust barriers 20, 26. A moisture free gas such as dried nitrogen fills the tube interior and is trapped between sealant plugs 44, 46 such that there is no air pocket in the tube interior.

To assemble the lighting tube of the invention, the tube 12 is first cut to length and openings 30, 32 are drilled in the tube wall 34. Each opening may have a diameter of $\frac{1}{8}$ inch and may be located $\frac{3}{4}$ of an inch from the associated tube end. The miniature lamps 36 are soldered to conductors 38 and the conductors are soldered at junctions 40, 42 (42') to the socket 18 and cable wires 22, 24 (or socket 28). The assembly of miniature lamps, conductors and connectors is then located in the tube interior as shown in FIG. 1. The socket 18 and cable wires 22, 24 (or socket 28) including junctions 42 (42'), 44 are embedded in the heated potting compound which is then allowed to cool. As the potting compound cools, it hardens and adheres to the interior surface of the tube wall and to the associated electrical connector, i.e., the cable wires 22, 24 (or socket 28) and socket 18. Once hardened, the potting compound provides a dust barrier and a superior strain relief 20 or 26.

A pressurized moisture free gas such as dried nitrogen is then introduced into the tube interior (for example at 3 psi) through one of the openings 30 (32). Ambient, moisture laden air is therefore displaced and expelled from the tube interior via the other opening (32 (30). The silicone compound is then injected through both openings 30, 32 so as to fill a region of the tube interior proximal each dust barrier including the openings 30, 32 and any gaps between dust barriers 20, 26 and the interior surface of the tube wall. The compound molds to the internal shape of the tube to provide a sealant plug 44, 46 at each opening. Thus, openings 30, 32 are sealed from the tube interior and need not be capped externally.

The sealant plugs 44, 46 trap the moisture free gas within the tube interior. The sealant plugs 44, 46 also prevent moisture from entering the tube interior. Since the trapped gas is moisture free, no condensate can form within the tube interior. The result is a moisture free, moisture resistant tube which houses the miniature lamps, conductors, and electrical connectors. Since the miniature lamps and conductors are surrounded only by the moisture free gas, the lamp circuit can be extricated from tube 12 without damaging the lamps or conductors to enable the circuit to be repaired. To repair the lamp circuit, the tube is cut at each end portion, just behind each strain relief (toward the sealant side). The sealant is then cut out, and the lamp circuit is withdrawn intact from the tube interior. The lamp circuit is then repaired and inserted in a new tube which is assembled as previously described.

The present invention may be embodied in other specific forms without departing from the spirit or essential attributes thereof and, accordingly, reference should be made to the appended claims, rather than to the foregoing specification, as indicating the scope of the invention.

I claim:

1. A moisture resistant lighting tube for housing miniature lamps, comprising:

a tube of light transmissive material having closed end portions, a miniature lamp circuit disposed within the tube interior, a substantially moisture-free gas filling the tube interior between said closed end portions, a first opening in a wall of said tube between said closed end portions for admitting substantially moisture-free gas into said tube interior to displace moisture-containing air from the tube interior, a second opening in a wall of said tube between said closed end portions for discharging moisture-containing air displaced by said gas from the tube interior, and means for forming a moisture tight seal at said first and second openings along the tube interior to prevent entry of moisture therein.

2. Moisture resistant tube according to claim 1 wherein the gas is nitrogen.

3. Moisture resistant tube according to claim 1 wherein the gas is pressurized.

4. Moisture resistant lighting tube for housing miniature lamps, comprising:

a tube of light transmissive material, a rigid plug at each of two spaced locations along the tube interior, each plug encasing an electrical connector, said tube having an opening at each of two spaced locations, each opening being spaced inwardly of a rigid plug, one of said openings serving to admit substantially moisture-free gas into said tube interior to displace moisture-containing air from the tube interior, the other of said openings serving to discharge moisture-containing air displaced by said gas from the tube interior, a sealant plug disposed at each of two spaced locations along the tube interior so as to seal each of said openings, a substantially moisture-free gas filling the tube interior between said sealant plugs, and miniature lamps disposed within said tube interior and electrical conductor means connected to said lamps, said electrical conductor means being connected to each of said electrical connectors at a junction within a rigid plug whereby each rigid plug serves as a strain relief for the junction.

5. Moisture resistant tube according to claim 4 wherein said gas is nitrogen.

6. Moisture resistant tube according to claim 4 wherein said sealant plug is a silicone compound.

7. Moisture resistant tube according to claim 4 wherein said rigid plug is a thermoplastic potting compound.

8. Moisture resistant lighting tube according to claim 4 wherein the gas is pressurized.

9. A moisture resistant lighting tube for housing miniature lamps, comprising:

a tube of light transmissive material, a miniature lamp circuit disposed within the tube interior, barrier means for encasing a first portion of the miniature lamp circuit and for providing a dust barrier at a first location along the tube, barrier means for encasing a second portion of the miniature lamp circuit and for providing a dust barrier at a second location along the tube, and a first opening in said tube for admitting substantially moisture-free gas into said tube interior between said barrier means to displace moisture-containing air from the tube interior, a second opening in said tube for discharging moisture-containing air displaced by said gas from the interior of the tube between said barrier means.

10. A moisture resistant lighting tube according to claim 9 including a substantially moisture-free gas filling the tube interior, and means for forming a moisture tight seal at said first and second openings along the tube interior to prevent entry of moisture through the openings into the tube interior.

11. A moisture resistant lighting tube according to claim 10 including means for forming a moisture tight seal at each of said barrier means to prevent entry of moisture across the barrier means into the tube interior.

12. A moisture resistant lighting tube according to claim 11 wherein each of said barrier means is a thermoplastic potting compound and wherein said means for forming a moisture tight seal is a silicone compound.

* * * * *